US006463893B1

(12) United States Patent
Foster et al.

(10) Patent No.: US 6,463,893 B1
(45) Date of Patent: Oct. 15, 2002

(54) COOLING FAN DRIVE SYSTEM

(75) Inventors: James A. Foster; Jeffrey L. Slunder, both of Decatur; Scott M. Longhurst, Lockport, all of IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/703,111

(22) Filed: Oct. 31, 2000

(51) Int. Cl.[7] ..... F15B 11/16
(52) U.S. Cl. ..... 123/41.49
(58) Field of Search ..... 123/41.12, 41.49

(56) References Cited

U.S. PATENT DOCUMENTS 4,179,888 A * 12/1979 Goscenski, Jr. ..... 123/41.12
4,223,646 A * 9/1980 Kinder ..... 123/41.49
4,312,379 A * 1/1982 Kinder ..... 137/625.48
4,433,648 A 2/1984 LeBlanc
4,446,697 A * 5/1984 Goscenski, Jr. ..... 123/41.12
4,487,255 A 12/1984 Bianchetta et al.
4,558,769 A * 12/1985 Neisen ..... 192/3.31
4,738,330 A * 4/1988 Suzuki et al. ..... 123/41.12
4,798,050 A * 1/1989 Nakamura et al. ..... 60/329
5,165,377 A 11/1992 Hosseini
5,216,983 A * 6/1993 Nilson ..... 123/41.12
5,359,969 A 11/1994 Dickrell et al.
5,427,195 A * 6/1995 Paul et al. ..... 180/308
5,590,624 A 1/1997 Emond et al.
5,960,748 A * 10/1999 Lewis ..... 123/41.19
5,975,233 A * 11/1999 Eisenbacher ..... 180/417
6,076,488 A * 6/2000 Yamagishi ..... 123/41.49
6,308,665 B1 * 10/2001 Lewis ..... 123/41.19

* cited by examiner

*Primary Examiner*—Noah P. Kamen
*Assistant Examiner*—Jason Benton
(74) *Attorney, Agent, or Firm*—Andrew Calderon; Thomas L Derry

(57) ABSTRACT

A cooling fan drive system for connecting a charge pump to an output of a cooling fan motor. This arrangement allows hydraulic fluid to be suctioned into the charge pump when the charge pump is remote from a hydraulic tank. The cooling fan drive system has a hydraulic tank that stores hydraulic fluid. A cooling fan pump is connected between the hydraulic tank and a cooling fan motor. A connector is connected between the cooling fan motor, the charge pump and the hydraulic tank. This arrangement allows flow of hydraulic fluid from the cooling fan motor to the charge pump.

27 Claims, 1 Drawing Sheet

COOLING FAN DRIVE SYSTEM

TECHNICAL FIELD

This invention relates generally to a cooling fan drive system and, more particularly, to an arrangement of components of the cooling fan drive system.

BACKGROUND ART

Internal combustion engines include cooling fan drive systems. The cooling fan drive systems cool the internal combustion engine, and may also be used to drive components of either the internal combustion engine or a machine which is powered by the internal combustion engine. The machine may include, for example, power generation sets, earth working machinery, paving machinery, load transfer carrying machinery and the like.

The cooling drive assembly may be based on a hydraulic system. In these systems, four hydraulic pumps are typically connected to a hydraulic tank. The pumps suction hydraulic fluid from the hydraulic tank in order to perform the specific function of the pump. These pumps are positioned proximate to the associate component performing the specific function regardless of the position of the hydraulic tank. For example, an implement pump will suction hydraulic fluid from the hydraulic tank in order to drive the many components of the machine such as, for example, the steering mechanism. Similarly, a charge pump will suction hydraulic fluid from the hydraulic tank in order to "charge" an all wheel drive (AWD) pump. The AWD pump is used to drive wheels of the machine in either a forward or reverse direction and is positioned on a front side (e.g., a forward side of an articulation joint of the machine) of the machine closest to the wheels which are driven by the AWD pump. The cooling drive assembly also includes a cooling tank used to cool the hydraulic fluid prior to being returned to the hydraulic tank.

However, it is impractical and in some instances impossible to supply hydraulic fluid to the charge pump from the hydraulic tank. This is mainly due to a design of the internal combustion engine and the arrangement of the components thereon. For example, the internal combustion engine may be designed in such a manner that the hydraulic tank is mounted on a front portion of the machine while the charge pump must be mounted on an opposing and remote side of the internal combustion engine. In this case, a hydraulic line may not be able to be economically positioned and thus connected between the charge pump and the hydraulic tank. Also, the hydraulic line may be able to connect the charge pump and the hydraulic tank, but the charge pump would not be able to provide enough suction to force the hydraulic fluid from the hydraulic tank through the hydraulic line and into the charge pump. In any event, the hydraulic system cannot then be efficiently used to operate components of the machine.

U.S. Pat. No. 4,433,648 to Leblanc, which was issued on Feb. 28, 1984, shows an engine cooling system. The engine cooling system includes a fan and a fan motor as well as other components mounted thereon. Due to the design of the internal combustion engine, the fan motor is a belt driven motor. Also, due to design constraints of the internal combustion engine, there are no hydraulic components for changing or controlling the direction of the machine or for many various other functions.

The present invention is directed to overcoming one or more of the problems as set forth above.

DISCLOSURE OF THE INVENTION

In one aspect of the present invention a cooling fan drive system has a hydraulic tank that stores hydraulic fluid. A cooling fan pump is connected between the hydraulic tank and a cooling fan motor. A connector is connected between the cooling fan motor, the charge pump and the hydraulic tank. This arrangement allows the flow of hydraulic fluid from the cooling fan motor to the charge pump.

In another aspect of the present invention an internal combustion engine has a cooling fan drive system. The cooling fan drive system has a hydraulic tank for storing hydraulic fluid. An implement pump is connected to the hydraulic tank, and a cooling fan pump is connected between the hydraulic tank and a cooling fan motor. A filter is connected to the cooling fan motor and a connector is connected between the filter, a charge pump and the hydraulic pump. In this manner, the hydraulic fluid can flow from the cooling fan motor to the charge pump. An all wheel drive (AWD) pump is connected to the charge pump.

BEST MODE FOR CARRYING OUT THE INVENTION

Figure 1:
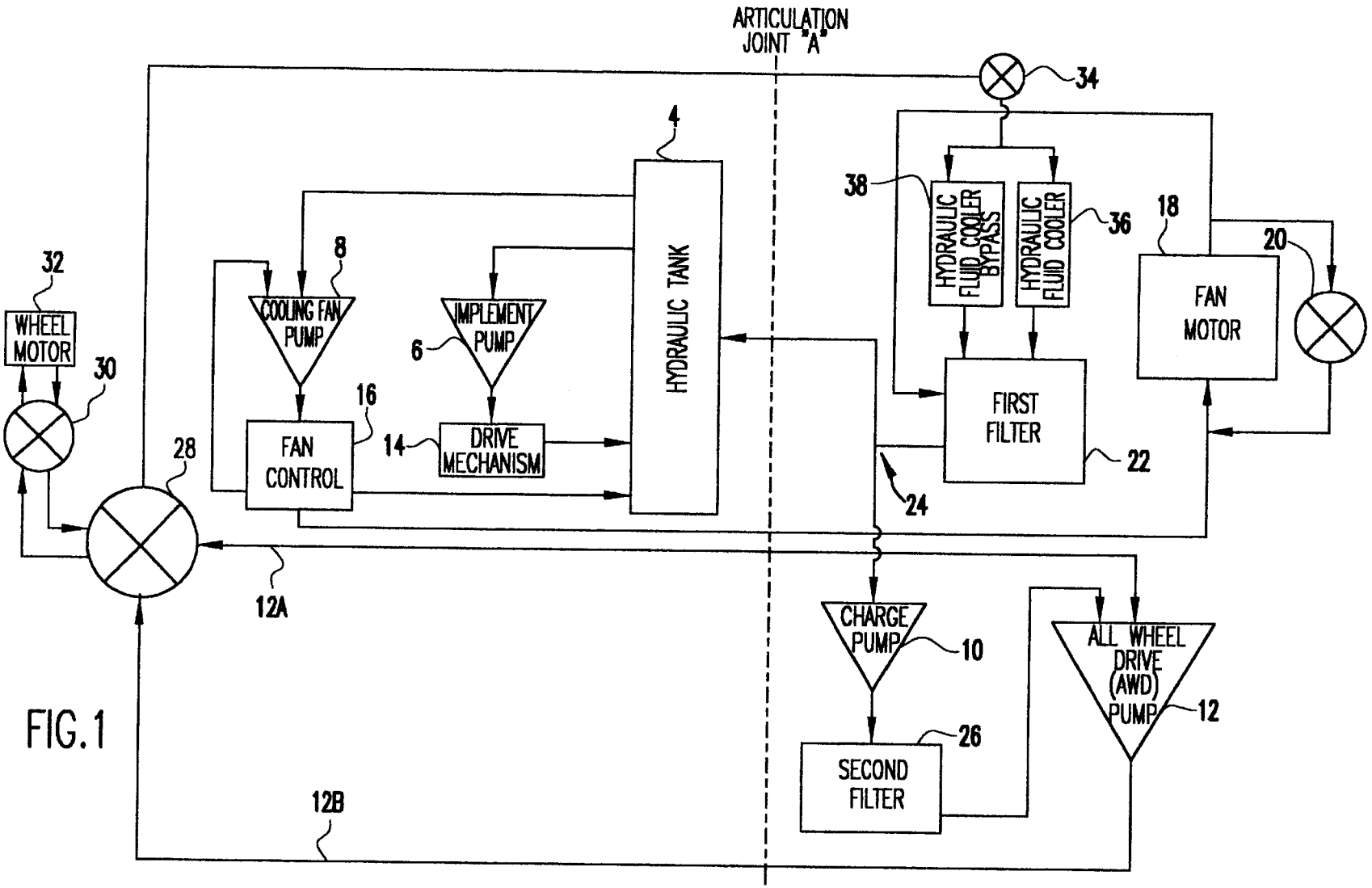
FIG. 1 shows a schematic view of a cooling fan drive system of the present invention.

FIG. 1 shows a cooling fan drive system adapted for use with an internal combustion engine and which is generally depicted as reference numeral 2. The cooling fan drive system 2 includes several components which are positioned on either side of an articulation joint "A" of a machine. As seen in FIG. 1 and as discussed in greater detail below, these many components communicate over the articulation joint "A".

The cooling fan drive system 2 includes a hydraulic tank 4 connected directly or indirectly (as discussed in greater detail below) to four hydraulic pumps. The four hydraulic pumps drive several components of the internal combustion engine (or a machine which is powered by the internal combustion engine) and include(i) an implement pump 6 and (ii) a cooling fan pump 8, (iii) a charge pump 10 and (iv) an all wheel drive (AWD) pump 12. The pumps 6, 8, 10 and 12 are well known in the art and a discussion of the particular features of these pumps 6, 8, 10 and 12 is thus omitted herein for clarity purposes.

Both the implement pump 6 and the cooling fan pump 8 are connected directly to an outlet of the hydraulic tank 4 on a first side (e.g., front side) of the articulation joint "A". The charge pump 10 is also connected to the outlet of the hydraulic tank 4, but can only obtain hydraulic fluid from the hydraulic tank 4 in limited circumstances. These limited circumstances include (i) at start-up of the internal combustion engine and (ii) when the internal combustion engine revolutions per minute (RPM) is at high idle (e.g., approximately 2200 RPM) and an engine cooling fan is at low idle (e.g., approximately 500 RPM). Both the charge pump 10 and the AWD pump 12 are positioned on a second side (e.g., rear side) of the articulation joint "A".

Still referring to FIG. 1, a drive mechanism 14 is connected to the outlet of the implement pump 6. The drive mechanism 14 may include, for example, a steering mechanism, a blade or ripper mechanism used with heavy machinery (e.g., grader)) and the like. The drive mechanism 14 is also connected to an inlet of the hydraulic tank 4. The (i) hydraulic tank 4, (ii) implement pump and are all positioned on the first side of the articulation joint "A".

An electro-hydraulic fan control 16 (proportional valve) is connected between an outlet of the cooling fan pump 8 and the inlet of the hydraulic tank 4. The electro-hydraulic fan control 16 is also connected to an inlet of the fan motor 18 (including an engine cooling fan). The electro-hydraulic fan control 16 is also connected to another input of the cooling fan pump 8 to provide a. feedback loop. It is noted that the electro-hydraulic fan control 16 is positioned on the first side of the articulation joint "A" while the fan motor 18 is position on the second side of the articulation joint "A", remote from the co electro-hydraulic fan control 16.

An anti-cavitation valve 20 is connected between the inlet and an outlet of the fan motor 18. The fan motor 18, in turn, may be connected to an inlet of a first filter 22. A T-connector 24 or other similar connector having two outlets and one inlet (hereinafter referred to as a T-connector) extends from an outlet of the first filter 22. The first outlet of the T-connector 24 extends over the articulation joint "A" to the first side thereof and is connected to an inlet of the hydraulic tank 4. And importantly, the second outlet of the T-connector 24 is connected to the inlet of the charge pump 10 on the second side of the articulation joint "A". The T-connector 24 may also be connected directly between the outlet of the cooling fan motor 18 and the inlet of the charge pump 10 and the inlet of the hydraulic tank 4. In this latter arrangement, the first filter 22 may be an internal component of the fan motor 18 so that the fan motor 18 can be connected directly to the charge pump 10 and the hydraulic tank 4 (via the T-connector 24).

The charge pump 10 is connected to a second filter 26 which, in turn, is connected to an inlet of the AWD pump 12 and an inlet of a flushing valve 28. The AWD pump 12 is a bi-directional pump which also is connected to the flushing valve 28 via lines 12*a* and 12*b*. In an "ON" mode of the AWD pump 12, the flushing valve 28 is connected in a return loop to a directional valve 30 and a wheel motor 32. In an "OFF" mode of the AWD pump 12, the flushing pump 12 is connected to an inlet of valve 34. The flushing valve 28, directional valve 30 and wheel motor 32 are positioned on the first side of the articulation joint "A"

The valve 34 is connected to an inlet of both a hydraulic fluid cooler 36 and a hydraulic fluid cooler bypass 38 (positioned on the second side of the articulation joint "A"). Both the hydraulic fluid cooler 36 and the hydraulic fluid cooler bypass 38 are connected to the inlet of the first filter 22. It should be understood by those of ordinary skill in the art that the first filter 22 may be internal to both the hydraulic fluid cooler 36 and the hydraulic fluid cooler bypass 38, and that the hydraulic fluid cooler 36 and the hydraulic fluid cooler bypass 38 may each be separately connected between the hydraulic tank 4 and the charge pump 10 via a T-connector.

INDUSTRIAL APPLICABILITY

In operation, the hydraulic fluid flows from the first filter 22 to the suction side (e.g., inlet) of the charge pump 10. This arrangement permits the charge pump 10 to efficiently and effectively suction hydraulic fluid to the charge pump 10 from the hydraulic tank when the design of the internal combustion engine makes it either impractical or impossible for such suctioning. It is further noted that in operation, the arrangement of the pumps 6, 8, 10 and 12 on either side of the articulation joint "A", allows for a reduction in hydraulic lines needed to provide hydraulic fluid to the many components of the present invention as well as the elimination of a large diameter suction line carried over an articulation joint between the hydraulic tank 4 and the charge pump 10.

It is possible for hydraulic fluid to be suctioned from the hydraulic tank 4 to the charge pump 10 when a pressure differential between the hydraulic tank 4 and the charge pump 10 is at such a level to allow such suctioning. These limited instances occur (i) at start-up when there is minimal pressure within the hydraulic fluid lines and (ii) when the internal combustion engine RPM is at high idle and an engine cooling fan is at low idle. In all remaining instances, the charging pump does not suction the hydraulic fluid from the hydraulic tank 4 to the charge pump 10.

Being more specific, hydraulic fluid is suctioned from the hydraulic tank 4 to the implement pump 6. The implement pump 6 then pumps the hydraulic fluid, at a predetermined pressure, to the drive mechanism 14. The drive mechanism 14 may include the steering mechanism or other components relating to heavy machinery. The pressure of the hydraulic fluid flowing from the implement pump 6 thus drives the many components of the heavy machinery. Once the energy is dissipated, (i.e., when the pressure of the hydraulic fluid drops to a certain level) the hydraulic fluid then returns to the hydraulic tank 4.

The hydraulic fluid is also suctioned from the hydraulic tank 4 to the cooling fan pump 8. The cooling fan pump 8 then pumps the hydraulic fluid to the electro-hydraulic fan control 16. The electro-hydraulic fan control 16 then feeds the hydraulic fluid (i) back to the cooling fan pump 8, (ii) to the fan motor 18 and (iii) the hydraulic tank 4. In feeding the hydraulic fluid back to the cooling fan pump 8, the electro-hydraulic fan control 16 can increase or decrease the flow of the hydraulic fluid in the cooling fan pump 8 thus increasing or decreasing the hydraulic fluid pressure in the cooling fan pump 8. This increase or decrease in hydraulic pressure is used to control the speed of the fan motor 18. (The speed of the fan motor varies with the pressure of the hydraulic fluid.) The hydraulic fluid may flow through the anti-cavitation valve 20 when the pressure of the hydraulic fluid on the inlet side of the fan motor 18 is less than the pressure of the hydraulic fluid on an outlet side of the fan motor 18.

Once the hydraulic fluid flows through the fan motor 18, the hydraulic fluid then flows to the first filter 22. At the first filter 22, the hydraulic fluid is filtered and suctioned to the charge pump 10 or returned to the hydraulic tank 4. By allowing the hydraulic fluid to be diverted to the charge pump 10 from the first filter 22, it is possible to supply the hydraulic fluid to the charge pump 10 when the internal combustion engine design would not otherwise permit the charge pump 10 to suction the hydraulic fluid from the hydraulic tank 4. Such an internal combustion engine design may include the charge pump being located at a remote position from the hydraulic tank due to the cooling fan occupying the charge pump position.

In the "OFF" mode of the AWD pump 12, the hydraulic fluid is pumped from the charge pump 10 through the flushing valve 28 and to the valve 34. Depending on the temperature of the hydraulic fluid, the hydraulic fluid will flow either into the hydraulic fluid cooler 36 or the hydraulic fluid cooler bypass 38. For example, the hydraulic fluid will flow into the hydraulic fluid cooler bypass 38 at initial start-up in cold weather conditions. This is because the hydraulic fluid does not need to be cooled by the hydraulic fluid cooler 36. The cool hydraulic fluid is then provided to the charge pump 10 via the T-connector 24.

In the "ON" mode of the AWD pump 12, the hydraulic fluid is pumped to the AWD pump 12 by the charge pump 10. The hydraulic fluid is then pumped from the AWD pump (via lines 12*a* or 12*b*) through (i) the flushing valve 28 and (ii) the directional valve 30 and (iii) to the wheel motor 32. The wheel motor 32 either drives wheels in a forward direction or a reverse direction. The hydraulic fluid then flows in a reverse direction through the flushing valve 28 and back through the AWD pump 12 via the lines 12*b* or 12*a*, respectively. A relief valve associated with the AWD pump 12 may regulate the hydraulic fluid pressure within the AWD pump 12.

Other aspects and features of the present invention can be obtained from a study of the drawings, the disclosure, and the appended claims.

What is claimed is:

1. A cooling fan drive system, comprising:

a hydraulic tank having an inlet and an outlet, the hydraulic tank stores hydraulic fluid;

a cooling fan motor having an inlet and an outlet;

a cooling fan pump connecting between the outlet of the cooling fan motor for providing the hydraulic fluid to the cooling fan motor;

a charge pump having an inlet and an outlet;

an all wheel drive (AWD) pump connecting to the outlet of the charge pump;

a connector having an inlet and a first outlet and a second outlet, the inlet of the connector connecting to the outlet of the cooling fan motor and the first outlet connecting to the inlet of the charge pump and the second outlet connecting to the inlet of the hydraulic tank so that hydraulic fluid can flow from the cooling fan motor to the charge pump, and an implement pump connecting to the outlet of the hydraulic tank, the implement pump driving at least one drive mechanism.

2. The cooling fan drive system of claim 1, wherein the implement pump, the at least one drive mechanism and the hydraulic tank form a closed loop and the connector is a T-connector.

3. The cooling fan drive system of claim 1, including an electro-hydraulic fan control connecting between the outlet of the cooling fan pump and the inlet of the cooling fan motor, the electro-hydraulic fan control controls a hydraulic fluid pressure within the cooling fan pump and a speed of the cooling fan motor.

4. The cooling fan drive system of claim 1, including:

a hydraulic fluid cooler having an inlet and an outlet; and a hydraulic fluid cooler bypass having an inlet and an outlet, the outlet of the hydraulic fluid cooler and the outlet of the hydraulic fluid cooler bypass connecting to the inlet of the charge pump and the inlet of the hydraulic tank.

5. The cooling fan drive system of claim 4, including a valve connected to the inlet of the hydraulic fluid cooler and the inlet of the hydraulic fluid cooler bypass, the valve diverting the hydraulic fluid to either of the hydraulic fluid cooler or the hydraulic fluid cooler bypass based on a temperature of the hydraulic fluid.

6. The cooling fan drive system of claim 4, including a filter having an inlet and an outlet, the inlet of the filter connecting to the outlet of (i) the hydraulic fluid cooler, (ii) the hydraulic fluid cooler bypass and (iii) the cooling fan motor, the inlet of the connector being connected to the outlet of the filter.

7. The cooling fan drive system of claim 6, including a flushing valve connecting to the outlet of the charge pump, the charge pump supplying the hydraulic fluid to the flushing valve when the AWD pump is in an "OFF" mode.

8. The cooling fan drive system of claim 7, including a second filter connecting between the charge pump and the AWD pump, the second filter further connecting the outlet of the charge pump to an inlet of the flushing valve.

9. The cooling fan drive system of claim 1, including a flushing valve connecting to the outlet of the charge pump, the charge pump supplying the hydraulic fluid to the flushing valve when the AWD pump is in an "OFF" mode.

10. The cooling fan drive system of claim 9, wherein the flushing valve is connected to the AWD pump.

11. The cooling fan drive system of claim 10, wherein the flushing valve directs the hydraulic fluid to a wheel motor for driving wheels in a first direction and a second direction.

12. The cooling fan drive system of claim 1, including an anti-cavitation valve positioned between the inlet and the outlet of the cooling fan motor.

13. The cooling fan drive system of claim 1, including:

an engine cooling fan connecting to the cooling fan motor; and an internal combustion engine, the engine cooling fan cooling the internal combustion engine during operation of the internal combustion engine.

14. The cooling fan drive system of claim 13, wherein the charge pump receives hydraulic fluid from the hydraulic tank only (i) at start-up of the internal combustion engine and (ii) when a speed of the internal combustion engine is at a higher idle than a lower idle of the engine cooling fan.

15. The cooling fan drive system of claim 14, wherein the higher idle is approximately 2200 revolutions per minute (RPM) and the lower idle is approximately 500 RPM.

16. The cooling fan drive system of claim 1, including an internal combustion engine, the charge pump receiving the hydraulic fluid from the cooling fan motor during operation of the combustion engine.

17. An internal combustion engine having a cooling fan drive system, comprising:

a hydraulic tank for storing hydraulic fluid;

an implement pump connecting to the hydraulic tank;

a cooling fan motor;

a cooling fan connecting to the cooling fan motor;

a cooling fan pump connecting between the hydraulic tank and the cooling fan motor for providing the hydraulic fluid to the cooling fan motor;

a filter connecting to the cooling fan motor;

a charge pump;

an all wheel drive (AWD) pump connecting to an outlet of the charge pump; and a connector having an inlet and a first outlet and a second outlet, the inlet of the connector connecting to an outlet of the filter, the first outlet connecting to the charge pump and the second outlet connecting to the hydraulic tank so that hydraulic fluid can flow from the cooling fan motor to the charge pump.

18. The internal combustion engine having a cooling fan drive system of claim 17, including an electro-hydraulic fan control connecting between the cooling fan pump and the cooling fan motor for controlling a speed of the cooling fan motor.

19. The internal combustion engine having a cooling fan drive system of claim 17, including:

a hydraulic fluid cooler connecting to the filter and the AWD pump;

a hydraulic fluid cooler bypass connecting to the filter and the AWD pump; and a valve positioned on an inlet side of both the hydraulic fluid cooler and the hydraulic fluid cooler bypass for controlling the flow of the hydraulic fluid from the valve to the hydraulic fluid cooler and the hydraulic fluid cooler bypass.

20. A cooling fan drive system for use on a machine having an articulation joint, comprising:

a hydraulic tank for storing hydraulic fluid;

an implement pump connecting to the hydraulic tank and positioned on a first side of the articulation joint;

a cooling fan motor positioned on a second first side of the articulation joint;

a cooling fan connecting to the cooling fan motor and positioned on the second side of the articulation joint;

a fan pump connecting between the hydraulic tank and the cooling fan motor for providing the hydraulic fluid to the cooling fan motor, the cooling fan pump being positioned on the first side of the articulation joint;

a charge pump positioned on the second side of the articulation joint;

an all wheel drive (AWD) pump connecting to an outlet of the charge pump and being positioned on the second side of the articulation joint; and a connector having an inlet and a first outlet and a second outlet, the inlet of the connector connecting to the cooling fan motor, the first outlet connecting to the charge pump and the second outlet extending over the articulation joint and connecting to the hydraulic tank.

21. The cooling fan drive system of claim 20, including an electro-hydraulic fan control connecting between the fan pump and the cooling fan motor for controlling a speed of the fan motor.

22. The cooling fan drive system of claim 20, including:

a hydraulic fluid cooler connecting to the AWD pump and positioned on the second side of the articulation joint;

a hydraulic fluid cooler bypass connecting to the AWD pump and positioned on the second side of the articulation joint; and a valve positioned on the second side of the articulation joint and connecting to an inlet of both the hydraulic fluid cooler and the hydraulic fluid cooler bypass.

23. The cooling fan drive system of claim 20, including a flushing valve connecting to the outlet of the charge pump and positioned on the first side of the articulation joint.

24. The cooling fan drive system of claim 20, including:

an internal combustion engine, the engine cooling fan cooling the internal combustion engine during operation of the internal combustion engine.

25. The cooling fan drive system of claim 20, wherein the first side of the articulation joint is a front side of the machine and the second side of the articulation joint is a rear side of the machine.

26. A machine, having a first frame portion and a second frame portion, said machine comprising:

an articulation joint disposed between said first and second frame portions, said first frame portion including an internal combustion engine, a cooling fan, an all wheel drive (AWD) pump and a charge pump mounted thereon, said all wheel drive pump being connected between said hydraulic tank and a wheel motor, said charge pump being connected between said hydraulic tank and said all wheel drive pump; and a second frame portion including a cooling fan pump and an implement pump, said cooling fan pump being connected between an outlet on said hydraulic tank and a cooling fan motor inlet, said implement pump being connected between an outlet on said hydraulic tank and a drive mechanism.

27. The machine of claim 26, said machine being a road grader.

* * * * *